US005307528A

United States Patent [19]

Nieuwenhuis et al.

[11] Patent Number: 5,307,528

[45] Date of Patent: May 3, 1994

[54] HANDLE

[75] Inventors: Franciscus J. M. Nieuwenhuis, Gouda; Casper J. F. De Jonge, Rotterdam, both of Netherlands

[73] Assignee: B. V. Linido, Pijnacker, Netherlands

[21] Appl. No.: 777,316

[22] PCT Filed: Nov. 6, 1990

[86] PCT No.: PCT/NL90/00168

§ 371 Date: Dec. 2, 1991

§ 102(e) Date: Dec. 2, 1991

[87] PCT Pub. No.: WO91/06238

PCT Pub. Date: May 16, 1991

[30] Foreign Application Priority Data

Nov. 6, 1989 [NL] Netherlands ..... 8902731

[51] Int. Cl.[5] ..... A47K 17/02

[52] U.S. Cl. ..... 4/576.1; 4/571.1; 4/605; D8/316; 16/110 R; 16/111 R

[58] Field of Search ..... 4/573.1, 576.1, 577.1, 4/571.1, 604, 605, 611, 504, 511, 589, 621; 248/200.1, 299, 649, 668; 211/105.2; 16/110 R, 111 R; D8/300, 303, 315, 316; D6/546, 549; D23/277

[56] References Cited

U.S. PATENT DOCUMENTS

| | | | |
|---|---|---|---|
| D. 199,333 | 10/1964 | Finley | D8/316 |
| 1,055,925 | 3/1913 | Lathrop | 211/105.2 |
| 2,005,576 | 6/1935 | Buhl et al. | 4/577.1 |
| 3,156,977 | 11/1964 | Logan | 211/105.2 |
| 4,944,478 | 7/1990 | Sullivan | 4/611 |
| 5,052,252 | 9/1991 | Cuttriss | 4/576.1 |

FOREIGN PATENT DOCUMENTS

| | | | |
|---|---|---|---|
| 547553 | of 1932 | Fed. Rep. of Germany | 248/299 |
| 357167 | 11/1961 | Switzerland | 4/576.1 |
| 1017671 | 1/1966 | United Kingdom . | |
| 2038981 | 7/1980 | United Kingdom . | |

*Primary Examiner*—Henry J. Recla
*Assistant Examiner*—Charles R. Eloshway
*Attorney, Agent, or Firm*—Beveridge, DeGrandi Weilacher & Young

[57] ABSTRACT

A handle for sanitary facilities such as toilet stalls for handicapped persons includes a middle portion with an elongated axis and two end portions which are bent at oblique angles from the axis. Each end portion is received in a projecting portion of a fastening device. The fastening device is formed of truncated cone-like bodies, one of which has screw-receiving holes which are covered by a snap-on cover.

17 Claims, 3 Drawing Sheets

HANDLE

The present invention relates to a handle, in particular for sanitary conveniences intended for invalids, partial invalids or older people, comprising a substantially oblong handle portion having on either side a fastening means having a fastening surface.

Such a handle is known and is mounted for instance to one of the walls in a toilet intended for invalids, partial invalids or older people, in order to offer support or grip to the user. The known handle consists of a handle portion in the shape of a steel tube which near each end is bent over an angle of 90°, so that the tube can be welded with its end faces perpendicular to two steel plates positioned in a plane. Each fastening plate is provided with two recesses for fastening the handle to the wall with screws or the like. The distance of the axis of the tube to the wall amounts to 80 mms. The tube diameter is about 30 mms.

This known handle shows a number of drawbacks. A considerable drawback of ergonomic nature is that when seizing near one of the ends bent over 90° the fingers of the hand are hard pressed which is painful and has as a result that no good grip is obtained, so that accidents may happen. A good grip is also counteracted in that, in particular in case of an obliquely positioned, lateral mounting of the handle, the wrist has to be turned a bit in seizing the handle near one of the ends. Besides, then the beads and burrs, if any, on the screws used for fastening may injure the hand. An additional drawback is the "hospital-like" appearance of the handle.

The object of the present invention is to provide a handle which ergonomically satisfies better than the known handle and which moreover may be of a finer appearance.

For this purpose in accordance with the invention a handle of the kind mentioned in the preamble is provided, characterized in that near each end of the handle portion its axis is at an angle with the fastening surface of considerably less than 90°.

Thus a good grip can be obtained along the entire available length of the handle portion in that also near the fastening means the fingers can be placed in a bent way beside each other without being clamped in. The wrist need not be turned for a grip at one end of the handle.

Preferably, the said angle is about 60°.

According to a further embodiment of the handle according to the invention, each fastening means comprises an upstanding portion adjacent to the fastening surface, which encloses the respective end of the handle portion at least substantially. In consequence hereof the handle, and in particular its fastening means, can be produced and designed in such a manner that the handle is comfortable in use under any circumstances. A further advantage of this embodiment is that, since each end of the handle portion is introduced at the oblique angle into the respective upstanding portion, the handle portion is enclosed and stopped by these upstanding portions without any further measures.

other features and advantages of the handle according to the invention will become clear after having read the following description of a preferred embodiment of the handle according to the invention with reference to the drawing, wherein.

Figure 1:
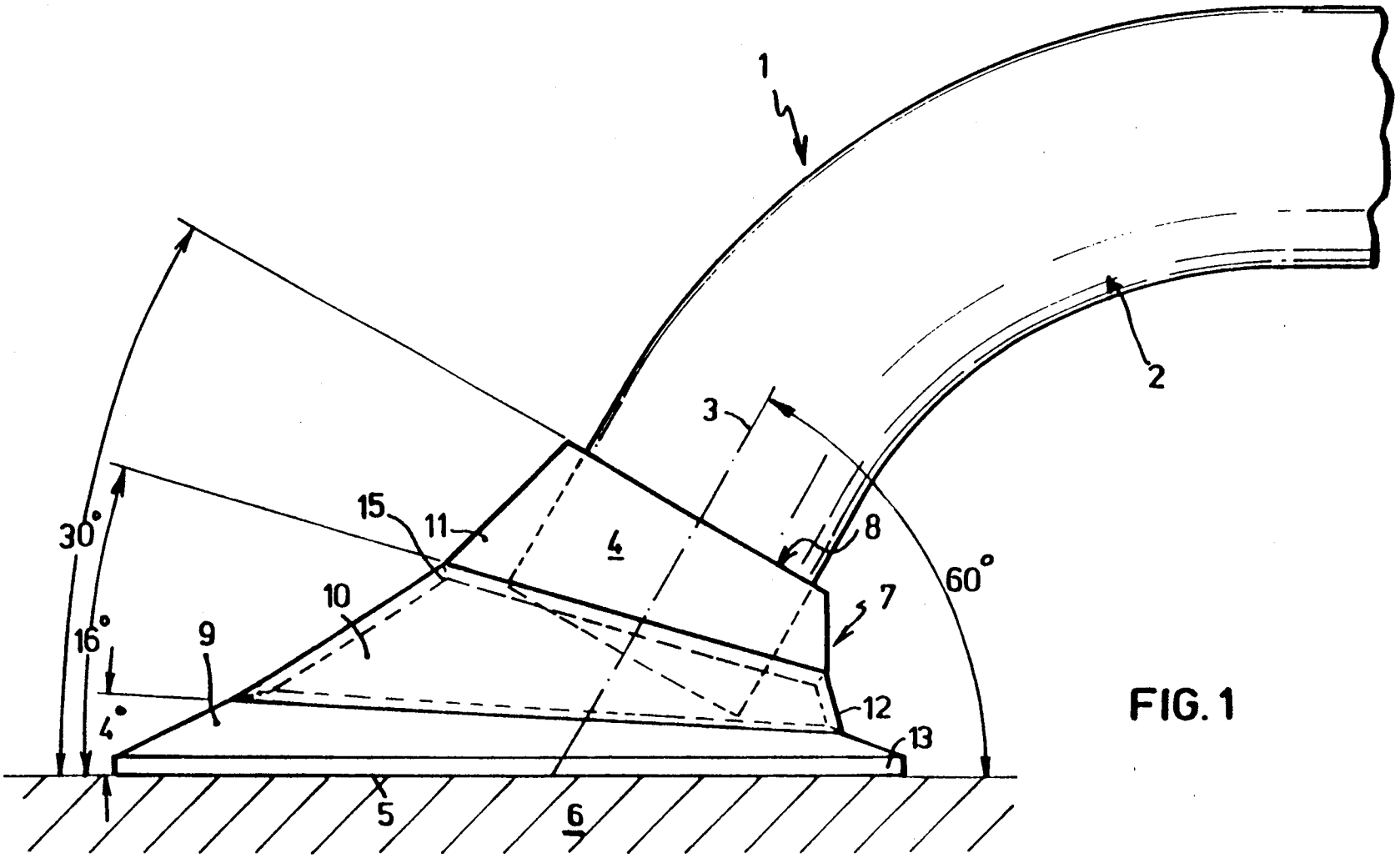
FIG. 1 is a partial side-view of a preferred embodiment of the handle according to the invention.

In FIG. 1 a preferred embodiment of a handle 1 according to the invention is represented. But, for clearness' sake only part of the handle is shown in the figure, the non-represented part being constructed in a way corresponding to the represented part. Hereupon, for that reason the description of the represented part of the handle 1 will do.

The handle 1 consists of a substantially oblong handle portion in this example having the shape of a tube 2 with a central axis 3 and with a fastening means at the end 4 showing a fastening surface 5. The handle can be fastened to a wall 6 by means of the fastening means.

The tube 2 is bent over about 60° near the end 4, so that the central axis 3 and the fastening surface 5 include an angle of about 60°. This angle of about 60° has turned out to be the most favourable in ergonomic respect. In order to be able to make use of the downwardly sloping ends of the handle portion as much as possible, the distance of the axis of the portion of the tube 2 extending parallel to the mounting surface to the fasting surface 5 is within a range of 90–100 mms. The diameter of the tube may be about 30 mms as usual.

On account of the fact that the fastening means comprises an upstanding portion 7 adjacent to the fastening surface 5, which encloses the respective end 4 of the tube 2, the fastening means is thus suitable for fastening to it the end 4 of the tube 2, being at an angle of 60° obliquely to the fastening surface 5. The upstanding portion 7 in this preferred embodiment is provided with a substantially circular recess for receiving the end 4 of the tube 2 at the end faced away from the fastening surface 5. A special treatment of the end face of the tube 2 can be omitted as a result hereof, whilst moreover, optionally with addition of an adhesive, a solid, permanent fastening to the fastening means is obtained, since the tube is enclosed and stopped by the fastening means thus constituted.

The upstanding portion 7 is constituted by three superposed, obliquely truncated, cone-like bodies 9, 10 and 11. In FIG. 1 the cone-like body 10 is represented in dotted lines, since it is covered by a cover 12.

Figure 2:
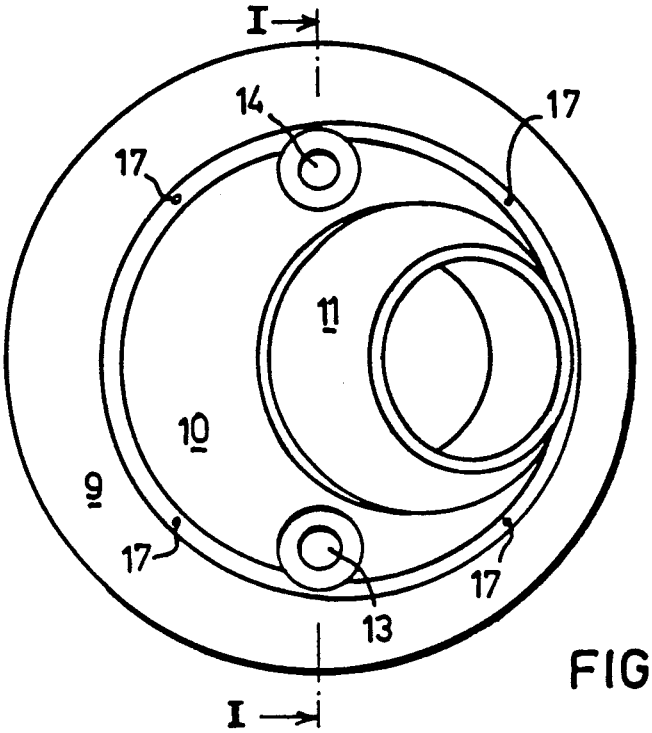
FIG. 2 is a top-view of a fastening means of the handle according to FIG. 1, a cover of which has been removed.

In FIG. 2 a top-view of the fastening means is shown, the cover 12 according to FIG. 1 having been removed, as a consequence of which recesses 13 and 14 are visible in the cone-like body 10 which are intended for receiving screws or the like, in order to be able to fasten the handle 1 to the wall 6.

As also appears from the drawing, the average diameter of the cone-like bodies is reduced in the direction from the fastening surface 5 and parallel to the axis 3 of the tube 2, in order to smoothly connect the tube 2 to the fastening surface 5. Therefore, preferably the dimensions of the lower surface of the cone-like body 9 are equal to those of the fastening surface 5. This fastening surface 5 may, of course, also be constituted by the lower surface itself of the cone-like body 9. As the peripheral portion of each cone-like body of the fastening means having the smallest height is present substantially on the side of the fastening means facing the other, non-represented, fastening means the most, the angle of about 60° can thus be obtained, the upper faces of the cone-like bodies respectively being at an angle of about 4°, 16° and 30°, as also indicated in FIG. 1. The upper and lower surfaces of the cone-like bodies have a circular periphery. The upper surfaces of the bodies 9, 10 and 11 may for instance have a diameter of 69, 44 and 33 mms, respectively.

Figure 3:
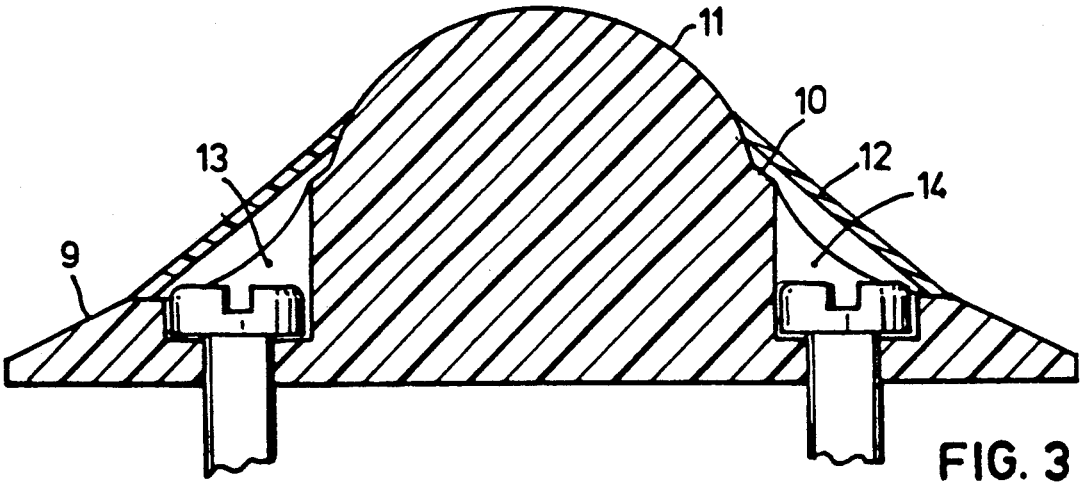
FIG. 3 is a view of, amongst other, a cross-section of the fastening means along the line I'I in FIG. 2.

Preferably, the cone-like bodies 9, 10 and 11 are made in one piece, as represented in FIG. 3, in which a cross section of the fastening means along the line I—I of FIG. 2 is shown. A suitable material for the fastening means is a glass-filled type of nylon. The tube 2 may be made of steel, optionally with a synthetic coating, or of synthetic material entirely.

Figure 4A:
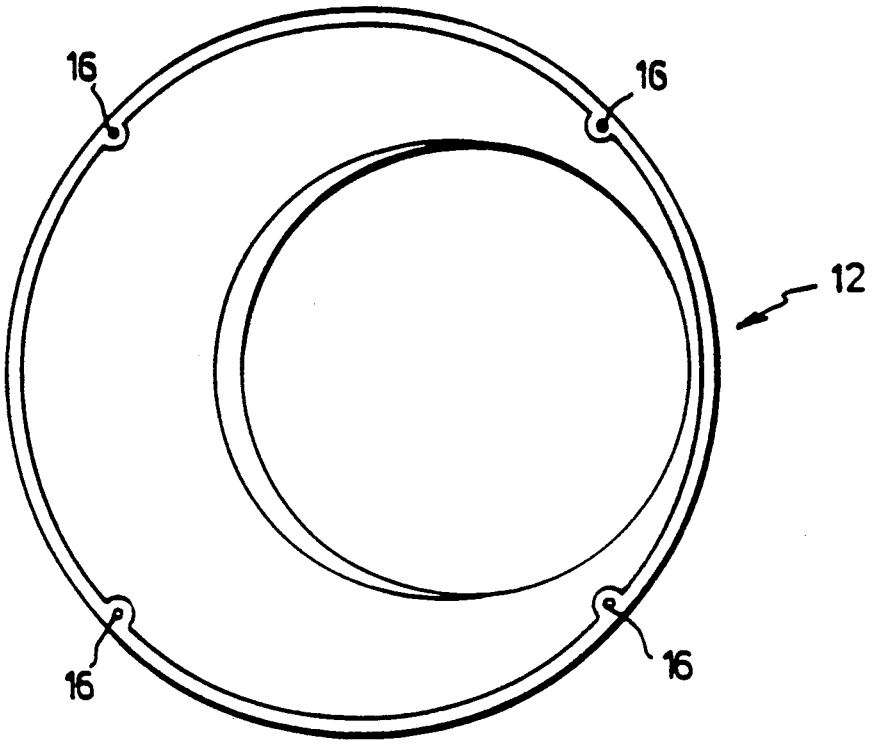
FIGS. 4A and 4B show respectively a bottom- and a side-view of the cover being part of the fastening means according to FIG. 2.
Figure 4B:
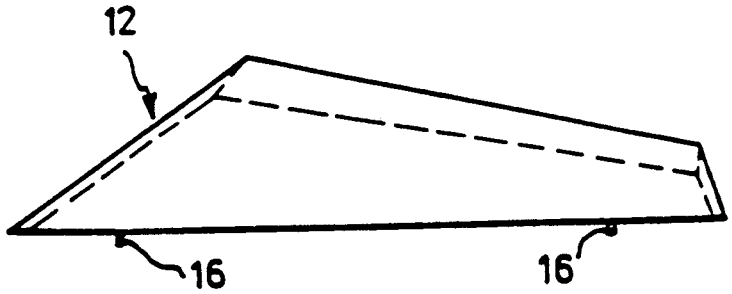

In FIG. 4A a bottom view of the cover 12 is represented, and in FIG. 4B a side-view hereof is represented. By this cover 12 the recesses 13 and 14 and the respective screws which have been mounted in the cone-like body 10, are covered, so that no dirt can pile up herein and the user cannot get hurt by any burrs of the screws. The cover 12 is also cone-like, in order to obtain together with the cone-like bodies 9 and 11 a perfectly smooth connection at the periphery of the fastening member. On the inner side, the cover 12 is preferably directly adjacent to the cone-like body 10 to transmit forces exerted on the cover 12 during the seizing. In consequence hereof a solid, painless grip near the fastening means is possible. Besides, a fine appearance is thus obtained. For the various parts of the handle various colours can be chosen.

For the fastening of the cover 12 a collar 15 is provided at the lower surface of the conical body 11, as illustrated in FIG. 1. The collar 15 can constitute a snap lock with the cover 12 in case the dimensions correctly correspond to the dimensions of the cover 12. The cover 12, if the same is of a sufficiently flexible material, may also be provided with a recess extending in axial direction over the entire height, in order, after having bent open the cover a little, to apply the same about the cone-like body 10 or about the tube 2 and consequently to shift the same over the cone-like body 10. The mutual dimensions in the latter embodiment are less critical then.

For correctly orienting the cover 12 when applying same, projections 16 may be provided, like represented in FIG. 4, which cooperate with corresponding holes 17 having been made in the cone-like body 9, vide FIG. 2. Instead of the projections 16 and holes 17, for the orientation also a slot may be provided in axial direction at the periphery of the cone-like body 10, said slot cooperating with a raised portion present on the inner side of the cover 12.

The handle according to the invention is particularly comfortable in use by the design to the fastening means and by the fact that at least the fastening means is made of synthetic material.

It will be clear that the invention is not limited to the preferred embodiment represented in the drawing and that many changes in the preferred embodiment described can be made without leaving the scope of the invention as described in the enclosed claims.

We claim:

1. A handle, particularly for use in sanitary facilities such as toilet stalls for handicapped persons, comprising:

an elongated handle portion having a middle and first and second ends, said middle having an elongated axis and said ends being bent at oblique angles from said axis;

fastening means located proximate said first and second ends, said fastening means having a projection portion mounted on a fastening surface, said projecting portion of each said fastening means receivingly engaging one of said first and second ends, and said fastening surface adapted to be mounted to a wall surface such that said elongated axis and said fastening surface are substantially parallel;

a recess located in said projecting portion for receiving one of said first and second ends of said handle portion; whereby when said handle portion is mounted to a flat wall surface via said fastening means, said first and second ends of said handle portion form an angle of substantially less than 90° with respect to said fastening surface.

2. A handle according to claim 1, wherein said oblique angles are about 60°.

3. A handle according to claim 1, wherein at least the ends of the handle portion have round cross sections and the projecting portion of the fastening means has an outer surface provided with a substantially round recess for receiving therein a respective end of the handle portion.

4. A handle according to claim 1 wherein the projecting portion is formed of a plurality of superposed, obliquely truncated cone-like bodies.

5. A handle according to claim 4, wherein each cone-like body has an average diameter which is less than the average diameter of the adjacent cone-like body which is beneath it.

6. A handle according to claim 4, wherein a lowermost said cone-like body of one of said fastening means has a height which is less than that of each other said cone-like bodies of the respective fastening means.

7. A handle according to claim 6, wherein there are three cone-like bodies.

8. A handle according to claim 7, wherein upper limits of the three cone-like bodies are defined by truncation planes which are at angles of about 4°, 16°, and 30° relative to the fastening surface.

9. A handle according to claim 4, wherein a lowermost cone-like body has a lower surface which has dimensions corresponding to those of the fastening surface.

10. A handle according to claim 4, wherein the cone-like bodies are made in one piece.

11. A handle according to claim 4, wherein each fastening means is provided with two screw-receiving holes formed in one of the cone-like bodies.

12. A handle according to claim 11, having a cover over the holes.

13. A handle according to claim 12, wherein the cone-like body which lies above the cone-like body provided with the holes forms a collar which is along an upper portion of the cone-like body provided with the holes.

14. A handle according to claim 13, wherein the cover is snap locked on the collar.

15. A handle according to claim 12, wherein the cover is flexible and is provided with an axially directed recess over its entire height.

16. A handle according to claim 1, wherein the fastening means are made of a glass-filled type of nylon.

17. A handle according to claim 1, wherein the elongated handle portion is 90–100 mm. long.

* * * * *